US005766082A

United States Patent [19]

Lochtefeld et al.

[11] Patent Number: 5,766,082

[45] Date of Patent: Jun. 16, 1998

[54] WAVE RIVER WATER ATTRACTION

[76] Inventors: Thomas J. Lochtefeld, 210 Westbourne, La Jolla, Calif. 92037; Jeffrey Wayne Henry, 305 West Austin, New Braunfels, Tex. 78130

[21] Appl. No.: 672,664

[22] Filed: Jun. 28, 1996

Related U.S. Application Data

[63] Continuation-in-part of Ser. No. 463,264, Jun. 5, 1995, Pat. No. 5,667,445, which is a continuation-in-part of Ser. No. 65,467, May 20, 1993, Pat. No. 5,421,782.

[51] Int. Cl.[6] ..... A63G 21/18

[52] U.S. Cl. ..... 472/117; 472/128

[58] Field of Search ..... 472/88, 89, 117, 472/128; 104/69, 70, 73; 405/79

[56] References Cited

U.S. PATENT DOCUMENTS

| | | |
|---|---|---|
| 419,860 | 1/1890 | Libbey . |
| 490,484 | 1/1893 | MacKays . |
| 799,708 | 9/1905 | Boyce . |
| 1,648,196 | 11/1927 | Rohmer . |
| 1,655,498 | 1/1928 | Fisch . |
| 1,701,842 | 2/1929 | Fisch . |
| 1,871,215 | 8/1932 | Keiler et al. . |
| 1,884,075 | 10/1932 | Meyers . |
| 1,926,780 | 9/1933 | Lippincott . |
| 2,815,951 | 12/1957 | Baldenza . |
| 3,005,207 | 10/1961 | Matrai . |
| 3,038,760 | 6/1962 | Crooke . |
| 3,085,404 | 4/1963 | Smith . |
| 3,404,635 | 10/1968 | Bacon et al. . |
| 3,473,334 | 10/1969 | Dexter . |
| 3,477,233 | 11/1969 | Andersen . |
| 3,478,444 | 11/1969 | Presnell et al. . |

(List continued on next page.)

FOREIGN PATENT DOCUMENTS

| | | |
|---|---|---|
| 1204629 | 10/1968 | Canada . |
| 96216 | 12/1983 | European Pat. Off. . |
| 761489 | 9/1933 | France . |
| 1019527 | 10/1952 | France . |
| 1300144 | 6/1962 | France . |
| 1539959 | 8/1968 | France . |
| 159793 | 8/1903 | Germany . |
| 373684 | 7/1932 | Germany . |
| 2222594 | 5/1972 | Germany . |
| 2714223 | 10/1978 | Germany . |
| 96216 | 2/1983 | Germany . |
| 52-41392 | 3/1977 | Japan . |
| 176562 | 4/1935 | Switzerland . |

(List continued on next page.)

OTHER PUBLICATIONS

Fauvelle/Blocquel, *Bravet D'Invention*, Sep. 19, 1933.

Hornung/Killen, *A Stationary Oblique Breaking Wave for Laboratory Testing of Surfboards*, Journal of Fluid Mechanics, May 7, 1976, vol. 78, Part 3, pp. 459–484.

Killen, *Model Studies for a Wave Riding Facility*, 7th Australian Hydraulics and Fluid Mechanics Conference, Brisbane, Aug. 1980.

Killen/Stalker, *A Facility for Wave Riding Research*, 8th Australasian Fluid Mechanics Conference, University of Newcastle, N.S.W., Dec. 2, 1983.

Dunn, *Splash Magazine*, "Wave Action Rivers", Jan. 1992, vol. XI, No. 1.

*Primary Examiner*—Kien T. Nguyen

*Attorney, Agent, or Firm*—Dickinson Wright PLLC

[57] ABSTRACT

The present invention relates to a water ride comprising a channel of water connected to a beach area, wherein a torrential flow of water can be released into the channel, to create a swell that travels through the channel, and then turns into a solitary tidal wave that spills and breaks onto the beach. The water in the channel can also be made to flow in a uniform direction, due to the momentum and energy transferred from repeatedly releasing the torrential flow of water into the channel. The curvature and orientation of the beach area relative to the channel causes the waves breaking onto the beach to travel radially outward in an arc-shape, causing the waves to spill over and break, as they make their way around the beach.

24 Claims, 12 Drawing Sheets

U.S. PATENT DOCUMENTS

| | | |
|---|---|---|
| 3,557,559 | 1/1971 | Barr . |
| 3,562,823 | 2/1971 | Koster . |
| 3,598,402 | 8/1971 | Frenzl . |
| 3,611,727 | 10/1971 | Blandford . |
| 3,789,612 | 2/1974 | Richard et al. . |
| 3,802,697 | 4/1974 | Le Mohaute . |
| 3,830,161 | 8/1974 | Bacon . |
| 3,851,476 | 12/1974 | Edwards . |
| 3,853,067 | 12/1974 | Bacon . |
| 3,913,332 | 10/1975 | Forsman . |
| 3,923,301 | 12/1975 | Myers . |
| 3,930,450 | 1/1976 | Symons . |
| 3,981,612 | 9/1976 | Bunger et al. . |
| 4,062,192 | 12/1977 | Biewer . |
| 4,149,710 | 4/1979 | Rouchard . |
| 4,194,733 | 3/1980 | Whitehouse, Jr. . |
| 4,196,900 | 4/1980 | Becker et al. . |
| 4,198,043 | 4/1980 | Timbes et al. . |
| 4,201,496 | 5/1980 | Andersen . |
| 4,276,664 | 7/1981 | Baker . |
| 4,278,247 | 7/1981 | Joppe et al. . |
| 4,339,122 | 7/1982 | Croul . |
| 4,392,434 | 7/1983 | Durwald et al. . |
| 4,429,867 | 2/1984 | Barber . |
| 4,522,535 | 6/1985 | Bastenhof . |
| 4,539,719 | 9/1985 | Schuster et al. . |
| 4,564,190 | 1/1986 | Frenzl . |
| 4,662,781 | 5/1987 | Tinkler . |
| 4,778,430 | 10/1988 | Goldfarb et al. . |
| 4,790,685 | 12/1988 | Scott et al. . |
| 4,792,260 | 12/1988 | Sauerbier . |
| 4,805,896 | 2/1989 | Moody . |
| 4,805,897 | 2/1989 | Dubets . |
| 4,836,521 | 6/1989 | Barber . |
| 4,905,987 | 3/1990 | Frenzi . |
| 4,954,014 | 9/1990 | Sauerbier et al. . |
| 5,421,782 | 6/1995 | Lochtefeld . |

FOREIGN PATENT DOCUMENTS

| | | | |
|---|---|---|---|
| 212138 | 4/1968 | U.S.S.R. . | |
| 682238 | 8/1979 | U.S.S.R. . | |
| 953075 | 8/1982 | U.S.S.R. . | |
| 375684 | 6/1932 | United Kingdom . | |
| 1090262 | 2/1965 | United Kingdom . | |
| 1118083 | 3/1966 | United Kingdom . | |
| 1159269 | 11/1967 | United Kingdom . | |
| 1204629 | 9/1970 | United Kingdom . | |
| WO8304375 | 12/1983 | WIPO . | |
| WO9006790 | 6/1990 | WIPO . | |
| WO92/04087 | 3/1992 | WIPO | 472/88 |

WAVE RIVER WATER ATTRACTION

RELATED APPLICATIONS

This application is a continuation-in-part of U.S. application Ser. No. 08/463,264, filed Jun. 5, 1995, now U.S. Pat. No. 5,667,445; which is a continuation-in-part of U.S. application Ser. No. 08/065,467, filed May 20, 1993, which issued as U.S. Pat. No. 5,421,782, on Jun. 6, 1995.

FIELD OF THE INVENTION

The present invention relates to the field of water rides, and in particular, water rides having a channel of water connected to a beach, and that create unique water effects, such as solitary waves and tidal waves, as well as residual waves resulting therefrom.

BACKGROUND OF THE INVENTION

Many water rides have been developed in recent years to recreate water and wave conditions that exist in nature. Due to the popularity of beach and river related water activities, for example, particularly during summer weather, many attempts have been made to recreate actual beach and river conditions in controlled theme park settings for commercial purposes.

Many wave pools, for example, having large pools of water and wave generating machines, along with a simulated beach, are now in existence throughout the country. Wave pools attempt to simulate actual beach conditions and create simulated waves. Ordinarily, in a wave pool, gentle moving periodic waves are created along the beach area to enable even the young and elderly to safely wade and play on the beach. The problem with wave pools, however, is that for water ride enthusiasts who prefer to play on the waves, it is necessary for them to swim or otherwise paddle out into the deep part of the pool first each time.

Lazy rivers have also become common in water theme parks throughout the country. Lazy rivers generally comprise a channel of water of swimming depth, wherein a mild current of water is provided in the channel to allow swimmers to swim and/or float in the river. Unlike wave pools, however, lazy rivers allow individuals to coast endlessly and effortlessly, if desired, in the water. But because the current is intentionally mild, very little water effects, other than the current, are provided upon which skimming and surfing manuevers can be performed.

No wave pools, nor lazy rivers, to date, have been combined to create a water ride with all of the advantages of both. Nor has there been any water ride in existence which can, in addition to creating periodic waves and currents, generate the kind of high speed water effects upon which skilled surfing and/or skimming manuevers can be performed. What is needed then is a water ride that not only provides the advantages of wave pools and lazy rivers, but also one that provides high speed, high impact water flows and effects, as well as unique wave effects not presently offered by any other water ride in existence.

SUMMARY OF THE INVENTION

The present invention relates to a water ride attraction comprising a large channel connected to a beach area, wherein a body of water is contained in the channel, and wherein a powerful forward moving swell can be formed in the channel that travels through the body of water, advancing toward the connected beach. Unlike the wave pools and lazy rivers discussed above, which recreate ordinary beach and river conditions, respectively, the present invention recreates, in addition to ordinary waves and currents, an extraordinary naturally occurring phenomenon—a tidal wave—that forms and breaks onto the beach as the swell moves toward and encounters the beach area. In the present invention, a single solitary wave is created by a dramatic sudden change in hydraulics, such as releasing a large quantity of water all at once into a relatively deep but confined channel area. Under such circumstances, a large swell can be formed by the momentum of water being released, upon which a rider can ride, or in some cases, surf. The swell then forms a breaking "tidal wave," upon which surfing and/or skimming manuevers can be performed, that breaks along the beach, as the wave approaches the upward sloped surface of the beach. The breaking wave forms, in many cases, a curling wave that breaks onto the beach, so that persons who are wading and/or otherwise playing on the beach can enjoy the wave as well. Many variations of the present invention can be created which incorporate the combination of the channel, the beach and the solitary wave to create various water effects, flows and trajectories.

The channel of the present invention is generally in the form of a loop and has side walls and a floor containing a body of water of swimming depth therein. At least one tidal wave generator is positioned near the channel loop, from which extends a discharge channel, which is sloped and tangentially connected to the channel, to allow water released from the tidal wave generator to be introduced unidirectionally into the channel. In the preferred embodiment, the tidal wave generator is adapted to draw a large quantity of water from the channel, at a location upstream from the discharge area, into a tank located immediately above the discharge channel. The tank is designed to release substantially all of the water in the tank in a short period of time onto the discharge channel, whereby the sudden release of water flows down the discharge channel and into the channel and creates a powerful surge or torrent of water that transfers energy, momentum and mass into the body of water in the channel. The sudden surge of water entering the channel creates a large forward moving swell that forms and travels unidirectionally through the channel loop. Alternatively, the tidal wave generator can be adapted to inject the same quantity of water upward through the channel floor to create a similar surge or torrent. The tidal wave generator is adapted to repeat this process at preselected time intervals so that a powerful surge can be created over and over through the channel. Just as swimmers and/or surfers can ride swells that naturally occur in the ocean, riders of the present invention can ride or otherwise manuever on the forward moving swell, which carries and accelerates the riders through the channel loop.

The swell that travels through the channel generally travels through the body of water, not with the flow of water. That is, the swell moves through the water by energy transfer, not fluid transfer, although not necessarily so. Accordingly, the width and depth of the channel preferably is substantially uniform throughout the channel loop, although not necessarilly so, to promote the uniform transfer of energy and momentum, and therefore, the uniform formation of the swell. The size and speed of the swell moving through the channel is preferably controlled by the tidal wave generator, and is affected by certain characteristics of the channel and discharge channel. The factors involved include the amount of water that is released, relative to the amount of water in the channel, and the rate and elevation at which the water is released into the channel from the tank. By adjusting the amount of water that is pumped into the tank, and/or controlling how quickly the water is released from the tank, and the elevation at which the water is released, the size and speed of the swell can be adjusted to suit the particular needs of the water ride, i.e., depending on the skill level of the riders. The slope and height of the discharge channel, as well as the angle of the discharge channel relative to the channel loop at the point of confluence, can also affect how the swell is formed.

Preferably, the slope of the discharge channel is sufficient enough to cause the water surging from the tank to flow in a predetermined direction, due to gravity, into the channel loop. The slope, however, should also be substantially gradual enough so that the surging water can enter the body of water without causing excessive turbulence, aeration, eddies, bubbles, flow shears, etc. For this reason, the discharge channel is preferably horizontal at the point of confluence so that the surge of water enters the body of water close to its surface. The discharge channel is also preferably narrowed at the point of confluence, such that the surge enters into the channel at a relatively isolated location along the channel loop. The discharge channel is also preferably interconnected to the channel substantially tangentially to the channel at the point of confluence such that the surge of water enters the channel substantially parallel to the direction of flow. This causes the surge of water from the discharge channel to enter the channel at the proper horizontal angle, which encourages the uniform formation of the swell.

The water being released into the channel creates, in addition to the forward moving swell, a unidirectional flowing body of water of swimming depth in the channel. Repeated surges from the tidal wave generator eventually causes the body of water in the channel to begin to flow, through momentum and energy transfer, in the direction of flow. The displacement of water in the channel caused by releasing additional water into the channel, i.e., mass transfer, helps to push the flowing body of water in the channel downstream. The additional water released into the channel from the tank also increases the depth of flow at the point of confluence, and, because water seeks its own level, which is downstream through the channel, water naturally flows downstream. There may be a tendency for some of the water from the surge to seek its own level in a direction that is against the direction of the flow of water in the channel, which is upstream and toward the area where water is withdrawn from the channel. This is particularly so because the level of water in the channal at the point where water is being withdrawn will be lower than the level of the water in the rest of the channel, and therefore, as water seeks its own level, it will tend to seek the lower elevation areas first, which in this case is upstream from the point of discharge. Nevertheless, because of the direction in which the discharge channel directs the surge, and the momentum, energy and mass transfer that is created in that direction, only some, if any, of the water at surface level actually travels in the opposite direction, while the water in the channel substantially flows unidirectionally around the channel loop.

The channel loop is, in the preferred embodiment, configured with an initial straight portion immediately downstream from the discharge area, which allows the swell to form, and to travel through the channel and build momentum. The channel loop is then, in the preferred embodiment, configured with at least one gradual turn downstream, which causes the swell, as well as the flowing body of water in the channel, to tilt slightly and be pushed up against the outside wall of the channel. This first turn is gradual enough that little energy is absorbed, and therefore, lost, as the swell and flow of water changes direction around the turn. Riders riding in the swell around the first turn will be able to manuever through the turn and experience the changes in water and flow conditions at that point.

After the first turn, in the preferred embodiment, the channel straightens out again, so that the swell builds momentum and heads toward the beach, which is located along the outside of another larger radius turn in the channel loop. The beach area is provided with a gradual upwardly sloped floor, so that as the swell moves through the channel and advances toward the beach area, water along the outside of the turn begins to flow upward along the beach floor, and as the swell approaches the beach, it begins to spill and then break, creating in many cases, due to the momentum and power of the wave, a curling wave breaking onto the beach.

The beach is located radially along the outside of the second turn, and has an upwardly sloped surface thereon that extends radially outward from the turn. The radius of curvature of the beach area is preferably substantially co-extensive with the radius of curvature of the second turn. The length of the beach is preferably sufficient, as will be discussed, to allow a breaking wave to form and extend all the way around the perimeter of the turn. The beach can be formed with sand, but is preferably formed with an artificial surface to prevent the problems associated with having loose sand flowing in the water around the channel loop. Although the beach is preferably of a size that is sufficient to allow breaking waves to form on the beach, and for various activities to be performed thereon, the beach can extend as far up the slope of the beach, and in whatever shape, as is desired.

The manner in which the beach area is connected to the channel enables the forward moving swell in the channel to advance toward the upwardly sloped surface of the beach at an angle, such that a spilling/breaking wave is created and extended around the perimeter of the turn, and therefore, the length of the beach, although not necessarily so. This spilling/breaking wave is created as the swell advances toward the upwardly sloped surface, whereby friction is increased along the floor of the beach, and naturally causes the top portion of the swell to travel faster than the bottom portion of the swell. The speed differential between the top of the swell and the bottom of the swell causes the top of the swell to spill over the bottom, creating a breaking wave that curls and travels forward onto the sloped surface of the beach. Because the swell created by the surge or torrent is preferably a single solitary swell, the spilling/breaking wave that breaks onto the beach is preferably more akin to a tidal wave, rather than a periodic wave. Of course, whether the swell is solitary or not depends largely upon the rate at which the water is released into the channel from the tidal wave generator. If the water is released all at once, the likelihood is that a single solitary swell, and therefore, a single solitary wave, will be created. If the water is released gradually, on the other hand, the likelihood is that a series of smaller periodic waves will be created, as the surge will be broken up and not form a unified movement of water through the channel. Riders that can manuever on the swell can, with sufficient skill, ride the tidal wave, and perform surfing and/or skimming manuevers thereon, as it forms, moves toward the beach, curls and breaks onto the beach. Persons wading or otherwise playing on the beach are also able to enjoy the wave as it approaches the beach area.

Most of the energy from the swell is expended as the spilling/breaking wave curls and breaks onto the beach. Because of the unique orientation and angle of the beach area relative to the channel, however, the spilling/breaking wave can actually continue to form and curl all the way around the perimeter of the turn, to form a continuous breaking wave that extends substantially the length of the entire beach, although the size and character of the extended portion of the wave will depend on several factors, including, but not limited to, the size and momentum of the original swell, the size, curvature, and orientation of the beach relative to the channel, and the degree of the beach slope.

As with other waves, because the channel is relatively narrow and opens up onto the relatively wide beach area, the swell, and therefore, the wave, that moves from the channel and into the beach area expands radially outwardly and travels in an arc-shape, extending outwardly at an equidistance from the point where the beach begins and the channel ends. The arc of the wave continues to spread outwardly onto the beach area, and because the beach area is in the shape of a larger arc (where the center of radii of the wave and beach, respectively, are located in different places, i.e., the center of radii of the wave is located on the arc of the channel), as the arc of the wave travels up the slope of the beach, the slope causes the wave to spill and break along that end of the arc. Although the arc of the wave continues around the beach in this manner, the end of the arc that encounters the upward slope of the beach continues to spill and break, forming a curling, breaking wave that extends in a sweeping arc around the beach.

In most cases, the wave that forms along the beach will become smaller as it progresses around the turn, which is a function of not only the factors discussed above, but also the expenditure of the wave's energy around the turn, and the curvature of the beach. The curvature of the beach, with respect to the direction at which the forward moving swell first encounters the beach area, becomes greater and greater further around the turn. Accordingly, the swell's energy and capacity to create a breaking wave becomes progressively reduced as the wave travels tighter and tighter around the turn. Because of this curvature, a powerful spilling/breaking wave can be created on one end of the beach, but as the wave travels around the turn, the wave will gradually become smaller and weaker.

In the preferred embodiment, a wall extends radially outward from the outside wall of the channel at the far end of the beach, such that the extended wave eventually encounters the wall, creating additional water effects, including forming a reverse wave caused by the original wave bouncing off of the wall and back toward the beach. In an alternate embodiment, the beach can be sloped upward at the far end of the beach, such that, as the wave travels around the beach, it eventually spills/breaks onto that portion of the beach. In this embodiment, the wave does not slam into the wall, as in the preferred embodiment. Nevertheless, a reverse wave is created, as the water travels up the slope of the beach and flows back down the slope, causing the reverse wave to travel against the next oncoming wave.

Due to the orientation of the beach relative to the channel, the present invention creates a gradually dissipating wave that provides various wave characteristics along different locations of the same beach. An advantage of the present invention is that people of varying skill levels and abilities, as well as preferences, can participate on the same beach at the same time, at different locations, depending on what kind of wave formation they prefer to ride. For example, skilled riders and surfers can ride the single solitary swell through the channel and possibly "catch" the spilling/breaking wave as it develops, breaks and "hits" the beach. Because the tidal wave can be relatively severe at this location, the wave that breaks along this area of the beach can be ideal for expert surfers and riders who prefer to perform "radical" surfing and/or skimming manuevers. Intermediate riders can also enjoy riding the intermediate curling/breaking waves along the intermediate areas of the beach. The intermediate area is for those who do not want to experience the severe water effects of the high impact areas, but still want to experience waves upon which ordinary surfing and/or skimming manuevers can be performed. In addition, those who prefer to wade in the water, rather than ride the waves, can play on the far end of the beach downstream from the high impact areas, where gentle residual waves are formed along the beach. And, due to the wall at the far end of the beach, and the reverse waves that are created as the waves bounce off of the wall, additional water effects and waves can also be enjoyed in this area of the beach. Various residual water effects and waves can also be created throughout the channel and beach areas, due to the waves and swells bouncing off of the walls along the channel and beach. Riders can also swim and/or float in tubes in the body of water in the channel, and can enjoy the various water effects therein. For these reasons, the water ride of the present invention can be enjoyed and experienced by persons of varying skill levels, including the most demanding water ride enthusiast, and the young and elderly alike.

At the far end of the beach area, the channel again narrows to its original size, with walls on either side. By that point along the turn, the breaking wave has expended its energy, forming only small residual waves. These residual waves are created, not only by the original swell, but also by the rebounding effects resulting from the back flows, waves and swells impacting the walls, and the flow of water in the channel. Water in the channel along the beach area also continues to flow downstream, although at a slower rate than the body of water in the rest of the channel. The water around the beach eventually flows into the channel again to complete the loop. While the relatively large volume of water in the beach area tends to slow down the flow of water around the beach, the repeated surges eventually cause the water in the channel to flow unidirectionally, even through the beach area, and to circulate around the loop.

Reverse waves and swells which travel through the channel in the opposite direction can also be created by the back flow of water, caused by the slope of the beach, and the relative differences in the depth of water between the beach area and the channel after the swell has passed through. After a solitary wave breaks onto the beach, the upward slope of the beach causes water from the wave to flow backwards against the direction of the wave, and back into the channel. The relatively deep swell that passes through the channel as it moves toward the beach also leaves behind a relatively shallow area of water in the channel. This hydraulic pressure differential caused by the swell, in combination with the sloped beach, causes a back flow to occur primarily along the surface of the water in the channel, as water seeks its own level, creating a reverse swell that travels in an opposite direction through the channel upstream. Accordingly, when another surge is created moments later by the tidal wave generator, the new swell meets the reverse swell head on, creating spectacular water effects at the point of encounter. Because the energy of the opposing swells are only slightly dissipated by the encounter, however, the swells simply cross over and continue to travel through the channel in the opposite directions.

Additional wave generators that create periodic waves can be positioned along the inside wall of the channel directly opposite the beach area. The generators can be directed radially outwardly from the inside wall to create additional periodic waves that break onto the beach. While the periodic waves flow onto the beach, they also create reverse back flows caused by the sloped surface of the beach, acting in a reverse direction on an advancing wave. When a spilling/breaking wave approaches and breaks onto the beach, therefore, the back flow of water caused by the periodic waves can encounter the spilling/breaking wave. The encounters between the solitary wave and the periodic waves, including the back flows, can create additional water effects along the beach. The periodic waves can also be used to control or diffuse the energy of the solitary waves, if desired, so that waves on one side of the beach will not be as severe as the waves on the other.

Other advantages of the present invention will become clear from the following description of the drawings, and the detailed description of the invention.

DETAILED DESCRIPTION OF THE INVENTION

Figure 1:
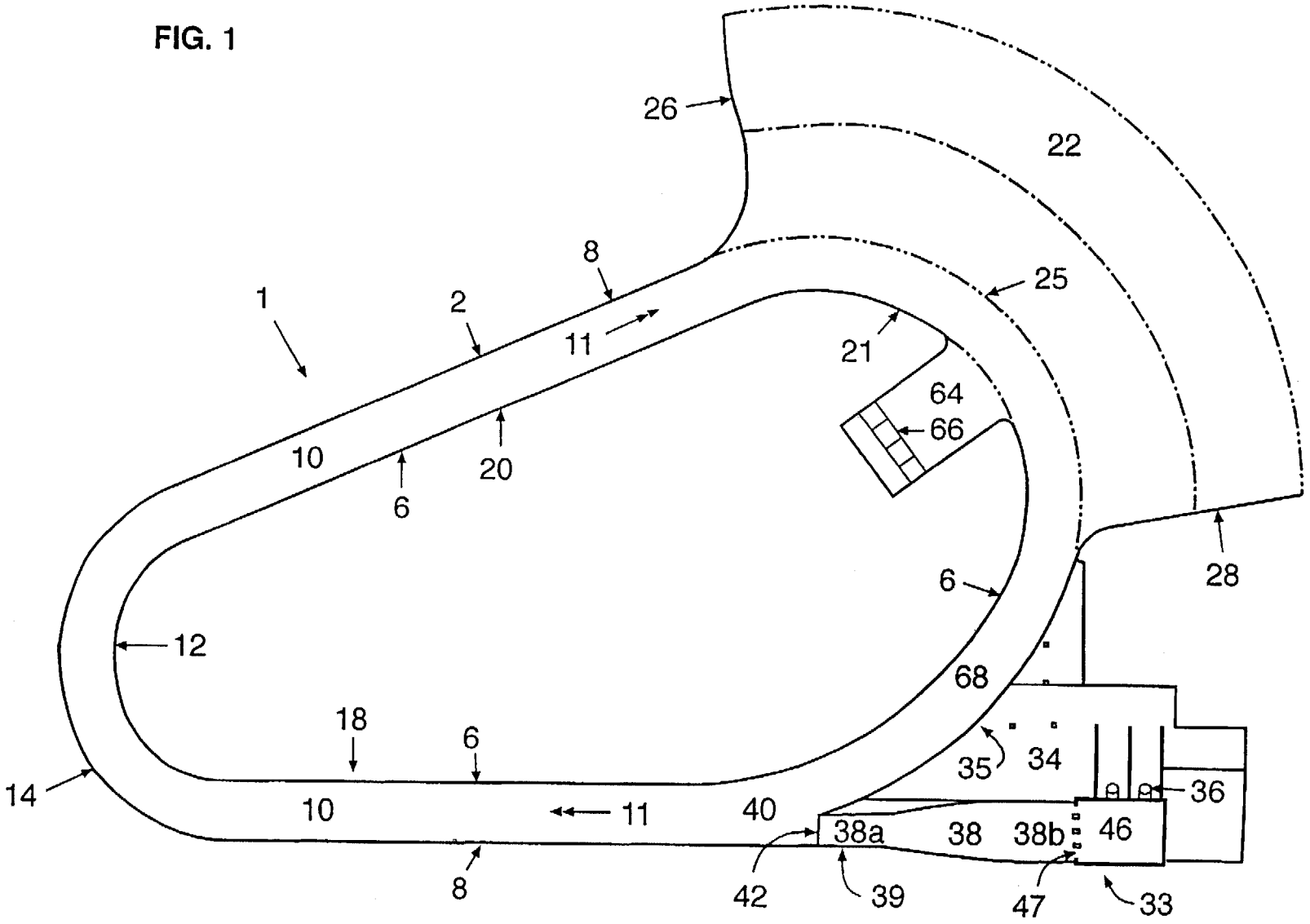
FIG. 1 is a plan view of the present invention.

As shown in FIG. 1, the present invention comprises a water ride in the form of a river loop 1 connected to a beach area 22. The loop can be in virtually any configuration that achieves the benefits discussed herein, or can be as shown, with two straight portions 18, 20 and two turns 12, 21, wherein the beach extends along the larger 21 of the two turns.

Figure 5A:
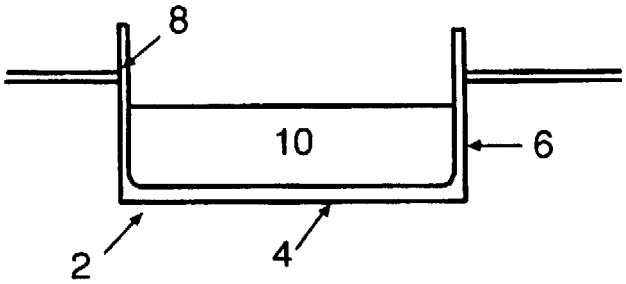
FIG. 5*a* is a section view of the channel.

In the preferred embodiment, the loop 1 is comprised of a channel or trough 2 generally having a floor 4 and two side walls 6, 8, as shown in FIG. 5*a*. The channel is generally large enough for containing a large quantity of water 10 and several riders 48 therein. In the preferred embodiment, the width and depth of the channel, including the elevation of the water therein, is substantially uniform throughout the loop, although not necessarily so. As will be discussed, in alternate embodiments, the channel can have variations in depth and width, as well as topographical changes, which can affect the flow of water through the channel.

Within the channel 2 is preferably a body of water 10, the surface level of which is generally substantially uniform, but for the effects created by the movement of water therein. While a more detailed discussion of the flow of the body water in the channel, as well as the creation of a large swell 50 that moves through the body of water, caused by releasing a large quantity of water, will be provided later, references to such water effects are made at this time for a better understanding of the factors that are involved in the design of the channel of the present invention. Unless otherwise specified, any dimension or amount given in the discussion is merely illustrative of and should not be construed as a limitation on the present invention.

The channel walls 6, 8 extend on either side of the channel and up generally from the floor 4 of the channel, although not necessarily so. In the preferred embodiment, the channel floor is substantially horizontal, and the walls are substantially vertical. In other embodiments, however, the channel walls and floor can be curved like a trough, U-shaped, or can be positioned at angles, or have variations, as previously discussed. While the walls and floor are preferably flat, various changes in topography are within the contemplation of the present invention, to create special water and visual effects.

The walls preferably extend sufficiently high above the surface level of the water in the channel, i.e., at least about one to two feet above the highest possible point of the largest possible swell that can be created in the channel, which is a function of the size and capacity of the tidal wave generator, as will be discussed. Accordingly, in the preferred embodiment, the walls extend up to about 6 feet or more above the surface level of the water in the channel, such that swells of up to 5 feet in height can be formed in the channel without causing water to undesirably flow over the channel walls. Because the depth of flow, when the water ride is not in operation, is generally about 3.5 feet, the walls generally extend up to about 9.5 feet or more above the channel floor. Of course, walls that are higher or lower are within the contemplation of the present invention, including walls that are about 3.5 feet above the water level, as shown in FIG. 5*a*. The outside channel wall 14 along the outside of the turn 12 is also generally higher, as water will tend to rise and be pushed up against the outside wall along the turn. The walls along the outside of the turn, as well as along the rest of the channel, can also be curved radially inward along the top to help maintain the swell, and therefore, the riders, within the channel. The channel floor can also be provided with a slight embankment to tilt the flow of water around the turn, which naturally occurs due to the momentum of the flow and centrifugal force around the turn.

The channel 2 can be made of concrete, or any strong material, such as fibre-glass, steel, wood, etc., and is preferably coated with a water-proof material 52, such as rubber, plastic, etc. The channel can be built into the ground so that the water level in the channel is generally about the same level as the adjacent ground, or the channel can be built above or below ground. The surface of the channel can also be covered with a relatively soft, impact absorbant, skid resistant material 54, such as foam, so that the risk of injury to the riders is reduced.

The length of the channel is preferably about 1,000 feet, although any length, from 100 feet, or less, to 5,000 feet, or more, are possible. At least the following factors determine the length of the channel: the size of available land, the anticipated number of people to ride the ride per hour, the desired size and speed of the waves/swells to be created in the channel, the desired speed and volume of the flow of water in the channel, the power of the surge created by the wave generator, the desired size of the adjacent beach, and the desired size of the breaking wave. The length of the channel is preferably short enough so that the swell in the channel, due to friction and energy loss, will not become completely dissipated by the time it reaches the beach area. On the other hand, the length is preferably long enough that the swell will form properly and move through the channel to form a breaking wave.

As shown in FIG. 1, a tidal wave generator 33 is provided to form the swell 50 that surges through the channel. The tidal wave generator is preferably positioned downstream from the beach 22, and upstream from the straight portion 18 of the loop. References to upstream and downstream are relative to the intended direction of flow, shown by arrow 11, of the body of water 10, rather than to a change in elevation. Various types of generators can be used, including both hydraulic and pnuematic generators, such as those disclosed in previous U.S. application Ser. No. 08/836,100, and U.S. Pat. No. 5,421,782, which are incorporated herein by reference. The preferred generator comprises at least one pump 36, a sump area 34, a tank 46, at least one opening 47, at least one release gate 44, and, if needed, pipes connecting the various components. The generator can direct water via a discharge channel 38 into the channel, or alternatively, introduce water through the channel floor. When the water is introduced through the channel floor, water is directed through the opening 47 through a grate located on the floor 4 of the channel. While the surge created in this manner begins below the surface level of the water, it nevertheless forms similar surges and swells.

The sump area 34 is located near or adjacent to the channel 2, and is provided with a grate 35, through which water from the channel can pass. The grate is positioned along the channel floor or walls to prevent riders from being accidentally drawn into the sump area. The pump 36 is located adjacent the sump area and adapted to draw water from the channel through the grate and into sump area, and to pump water into the tank 46. The rate at which the water can be pumped into the tank can vary, but preferably, each pump can pump at least about 50,000 gallons into the tank per minute, for maximum capacity. More than one pump can be provided if the rate needs to be increased.

Figure 2:
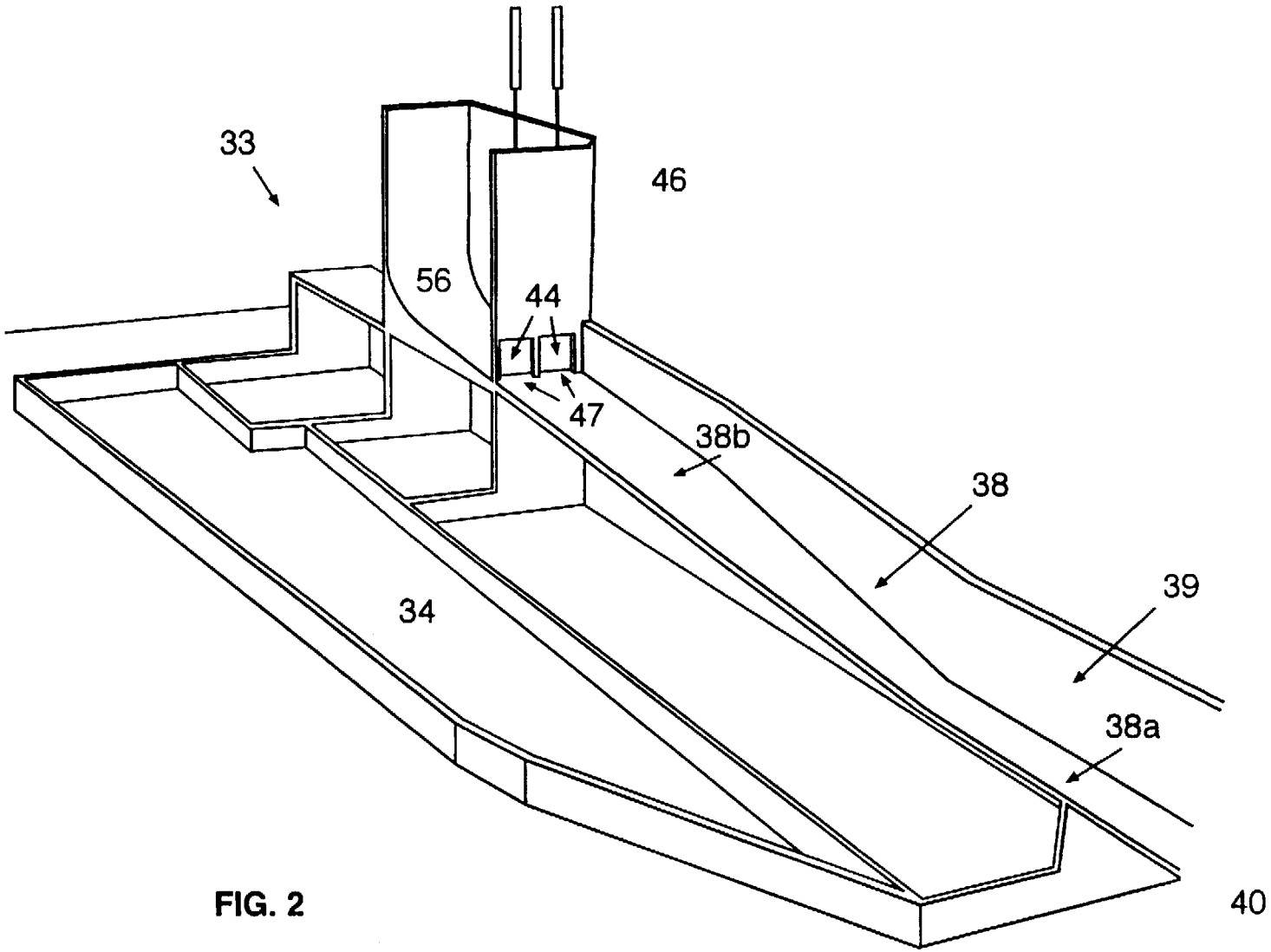
FIG. 2 is a perspective view of the tidal wave generator and discharge channel area.
Figure 3:
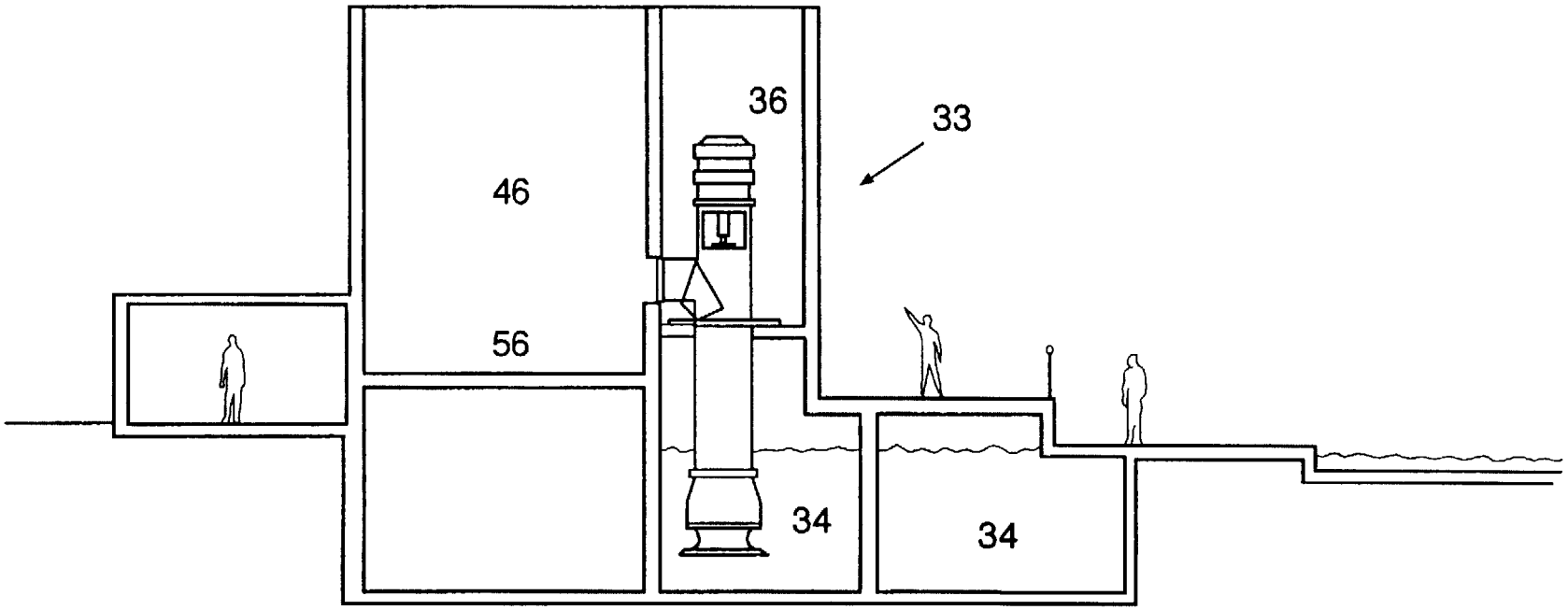
FIG. 3 is a section view of the pump and sump area.

The tank 46 is preferably large enough to hold enough water, i.e., up to 100,000 gallons or more, to create the kind of solitary waves described herein. The tank is preferably about 20 feet by 20 feet by 30 or more feet in height in dimension, although virtually any size and shape of tank is within the contemplation of the present invention. The bottom floor 56 of the tank can be sloped, as shown in FIG. 2, to facilitate the emptying of the tank when needed.

The opening (or openings) 47 is preferably provided along the bottom of the tank, such that when desired, substantially all of the water in the tank, due to gravity, can pass through the opening in a relatively short period of time. In the preferred embodiment, the size of the opening, in relation to the above stated tank capacity, is about 50 to 75 square feet, although this amount can vary depending on the capacity of the pump and tank. The overall opening is also preferably about 4 feet high, and about 20 feet wide. In the embodiment shown in the drawings, the opening comprises four separate openings, each being about 4 feet high and about 4 feet wide, positioned side by side, as shown in FIG. 2.

The release gate (or gates) 44 is provided at or near the bottom of the tank to cover the opening (or openings) as water is pumped into the tank. The release gate is preferably provided with controls which allow the gate to be opened at various speeds, and in various amounts, at various time intervals, ranging from every 10 seconds or less to every 2 minutes or more. The timing and sequence of the release gate can be controlled so that variable amounts, at variable intervals, can be released. For example, a series of three separate releases can be coordinated so that the first release releases a relatively small amount of water, and then the next two releases release amounts that are gradually increased. Preferably, the gate can be completely opened within less than about 4 seconds to allow water from the tank to flow out quickly. The gate, however, must be strong enough to withstand the pressure exerted by the water in the tank. The preferred gate can be hydraulically or pnuematically operated as a sliding, swinging or lifting door, but can also be operated in any other conventional manner. The preferred gate can also be controlled so that it can be held at a predetermined position, such that a predetermined amount of water can be released through the opening.

Figure 4:
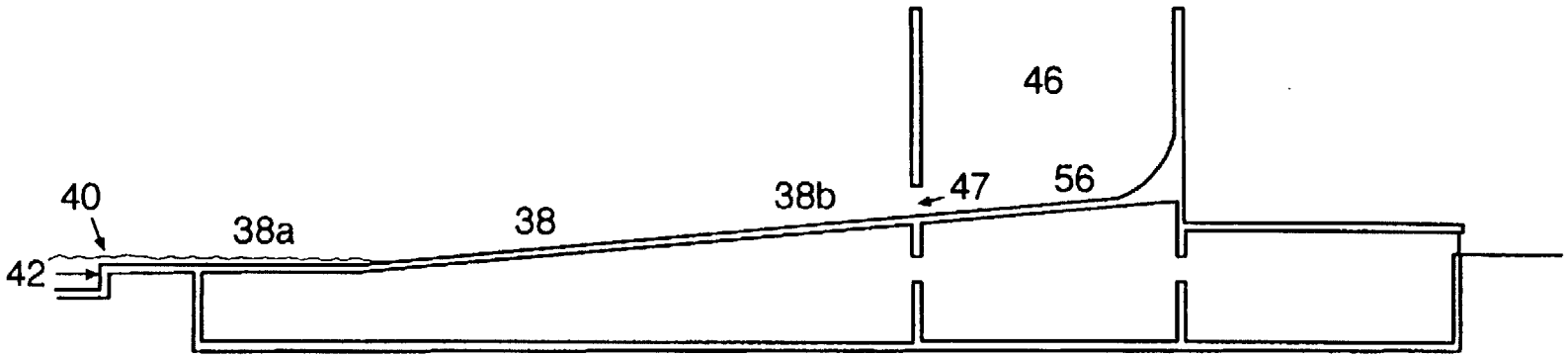
FIG. 4 is a section view of the discharge channel and tank.

The tank 46 is preferably positioned at an elevation that is higher than the level of water in the channel, as shown in FIG. 4, such that when the water in the tank is released, the water naturally flows, due to gravity, into the channel 2. A discharge channel 38 is positioned substantially between the tidal wave generator tank and channel 2, and tangentially interconnects the tank to the channel, as shown in FIG. 1. The discharge channel is preferably sloped and positioned immediately adjacent and below the tank opening 47, such that when water is released from the tank, water flows directly onto the discharge channel and into the channel. The slope of the discharge channel can vary, but preferably, the slope is about 12 to 1, or at least sufficient to cause water to flow downstream toward the channel loop. The slope preferably is, however, terminated near the bottom of the discharge channel, such that the floor is substantially horizontal at a location immediately prior to the channel 2. The horizontal portion **38*a* of the discharge channel is preferably about 20 feet in length, while the sloped portion 38*b* is preferably about 100 feet, although a wide range of lengths are within the contemplation of the present invention. The horizontal portion 38*a* of the discharge channel is also preferably about 6 inches below the level of the body of water in the channel at the point of confluence 40, and terminates at that point. With a preferred water depth of about 42 inches, this means that the discharge channel floor is, at the discharge area, about 36 inches above the floor of the channel. The terminating edge 42 of the discharge channel is preferably vertical and square with the discharge channel, although it can also extend around the perimeter of the second turn, flush with the channel wall 8**. The convergence of the water from the discharge channel with the body of water in the channel in this manner allows for the optimum transfer of momentum and energy into the body of water in the channel, without causing excessive turbulence, eddies, flow shears, swirls, bubbles, aeration, etc., although some level of water effects, to enhance the playability of the water ride, is acceptable.

The top of the sloped portion **38*b* of the discharge channel is preferably about the same width as the opening 47 of the tank to facilitate the free flow of water from the tank, as shown in FIG. 1. The horizontal portion 38*a* near the bottom of the discharge channel, however, is preferably narrower than the top, such that water flowing through the discharge channel converges within a relatively narrow shute portion 39** that leads directly into the channel. In the preferred embodiment, the discharge channel is about 20 feet wide at the top, and about 10 feet wide at the bottom, and varies in between, allthough virtually any width and variation that provides the benefits discussed herein are possible. Walls that are sufficiently high enough to contain the surging water are provided along the sides of the discharge channel to contain the water therein.

The angle at which the discharge channel 38 is connected to the channel 2 is preferably such that the maximum momentum and energy is transferred to the body of water in the channel in the predetermined direction. Preferably, as shown in FIG. 1, the discharge channel is positioned along the loop at the beginning of the straight portion 18, and consequently, at the end of the second turn 21, such that the discharge channel is oriented substantially in the same direction as the straight portion 18. Accordingly, the narrow shute portion 39 of the discharge channel is tangentially interconnected to the outside wall 8 along the end of the second turn 21. This means that the discharge channel is connected tangentially relative to the turn 18, as shown in FIG. 1, but parallel to the straight portion 18. Causing the surge of water to enter into the body of water in this manner helps to reduce the above mentioned undesirable water effects which can inhibit the formation of the swell in the channel.

Figure 6:
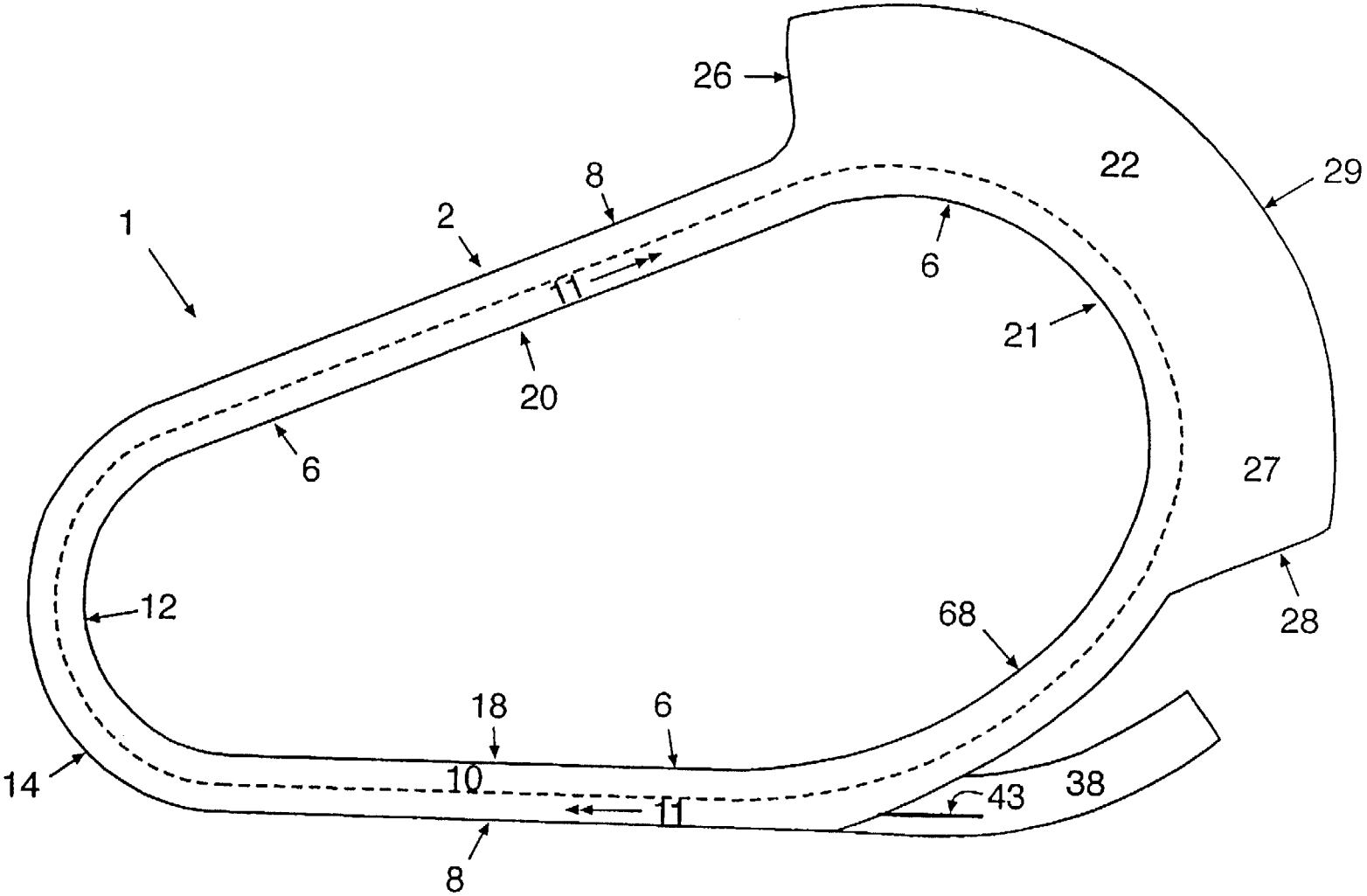
FIG. 6 is a plan view of an alternate embodiment.

The discharge channel can itself be straight, as shown in FIG. 1, or curved, as shown in FIG. 6. When the discharge channel is curved, as shown in FIG. 6, water flowing therethrough tends to lean up against the outside wall, causing a natural convergence, or narrowing, of the flow immediately prior to entering into the channel. In such case, the discharge channel can be narrowed at the bottom, as in the straight version, or can be provided with an additional center wall 43, to keep water entering the channel from crossing over into the middle of the channel, which can cause unnecessary water effects, such as aerations, bubbles, flow shears, eddies, vortexes, etc., which can inhibit the formation of the forward moving swell.

The preferred depth of the body of water in the channel, when the water ride is not in operation, as shown by the static water level 9, is about 42 inches, although the actual depth can vary somewhat without significantly changing the desired hydraulic conditions within the channel. The maximum depth of the water in the channel is preferably about 4 feet as a safety measure to minimize the risk of drowning, although not necessarily so. A depth that is any greater than 4 feet substantially increases the risk of drowning. The minimum depth of the water in the channel is a function of the desired water and rider effects within the channel. It is generally desireable to provide enough water depth to allow riders 48 within the channel to float, and in many cases, to swim as well. The depth of water is provided to ensure that floating devices, such as inner tubes 58, can float freely on the body of water without experiencing drag along the bottom. In the case of releasing a large quantity of water into the channel, the depth of water preferably is sufficient to permit a relatively deep swell 50 to form and move through the channel, while also allowing a deep body of water 10 to flow in the same direction at a slower speed. If the depth of the body of water is too shallow, the comparatively large quantity of water that is released into the channel could significantly overpower the water in the channel, such that the swell, rather than the body of water, physically moves through the channel. In such case, there is some danger that the swell could overpower the rider 48 and cause injury during the forward movement of the swell. This is not generally desirable, although variations in the depth of the body of water are well within the contemplation of the present invention. It is the relative difference between the depth of water in the channel and the amount of water released that can be coordinated to provide the optimum water effects and riding conditions.

The channel is generally about 20 feet wide, although channels ranging from 10 feet or less to 30 feet or more wide are acceptable, depending on the overall desired size of the water ride. The channel is preferably wide enough that several riders can float or otherwise safely ride the swell that forms in the channel when the large quantity of water is released. If the channel is too narrow, it may be difficult for more than one rider to ride the swell in the channel at one time, or for any one rider to safely manuever ahead of the swell through the channel. The width of the channel should also take into consideration the undesireable water effects which may result from a channel that is either too wide or too narrow. If the channel is too wide, for example, the water released into the channel may have a tendency to flow in different directions, such as against the channel walls, which can diffuse the formation of the swell. If the channel is too narrow, on the other hand, water in the channel could have the tendency of rebounding back and forth within the channel walls, making it difficult for a uniform forward moving swell to form. In this respect, friction along the channel walls, affecting both the flow of water and the movement of the swell, can also affect the water effects in the channel. Of course, the amount of space available, and the higher costs associated with larger channels, including the higher cost of operation, are additional factors which are considered in determining the size of the channel.

The channel is preferably uniform in width throughout the loop, although not necessarily so. The width of the channel can be altered when it is desireable to create various water effects, both in the flow of water in the channel, and in the movement of the swell through the channel. When the width of the channel is varied, the width should be calculated as a function of depth, or cross-sectional area, such that the proper flow characteristics and velocities are maintained. A narrowing of the channel, and a reduction in cross-sectional area, for instance, can cause the water flow to back up behind the narrow portion. On the other hand, a reduction in cross-sectional area can cause the water to accelerate through the narrow portion, as a function of mass conservation. In the case of a forward moving swell, a reduction in cross-sectional area will cause the swell to build up behind the smaller areas, and consequently, to slow down at that point, which in most cases is undesirable, but nevertheless is within the contemplation of the present invention. Additional variations to the depth and width of the channel should also take into consideration the friction caused by the surface area of contact between the water and the channel. With respect to just water flow, a wide shallow portion of the channel, having the same cross-sectional area as a narrow deep channel portion, may have a greater friction component, as the wider channel has a greater surface area exposed to water. But because the flow of water in the channel is preferably relatively slow, such friction losses will not greatly affect the flow of water in the channel. On the other hand, with respect to the movement of the swell through the channel, a relatively deep narrow portion of the channel, having the same cross-sectional area as a wide shallow portion, could have a greater friction component along the channel walls, such that the forward moving swell could build up, lose momuntum, and become compressed between the narrowing channel walls. If the channel width and depth are to be varied, these factors should be taken into consideration.

In the preferred embodiment, the straight portion 18 extends immediately downstream from the discharge area 40 so that the swell can form and build momentum through the channel, allowing riders to manuever and ride ahead of the swell. The straight portion, in the preferred embodiment, can run from 100 to 400 feet or more, depending on the overall size of the channel. At the end of the straight portion 18, there is a turn 12, that has, in the preferred embodiment, an inside radius of about 45 to 55 feet. Although a wide degree of radiuses are within the contemplation of the present invention, the preferred radius allows the body of water in the channel to flow easily around the turn without creating water effects that would inhibit the movement of the swell around the turn. If the radius is too small, the water along the turn could form excessive shears, eddies, boils and other effects, which could cause the movement of the swell through the channel to become turbulent. Moreover, with a small radius, even if the flow of water is relatively smooth, the swell itself may lose momuntum, power and energy as it travels around the turn. Indeed, there is also a danger that the swell could, if the radius is too small, slam against the outside wall, pushing the rider also against the wall, possibly causing injury, and causing various flow effects that will impede, rather than promote, the movement of the swell through the channel. The turn 12 also preferably extends something less than about 180 degrees around the turn.

At the end of the first turn 18, as shown in FIG. 1, the second straight portion 20 extends preferably in a direction towards the beach area 22. The second straight portion extends, in the plan view, generally towards the beach, but slightly at an angle away from the first straight portion 18, enabling a relatively large beach area to be created along the second larger turn 21. The second straight portion 20 extends about the same length as the first straight portion, although virtually any manner of lengths and relative lengths are within the scope of the present invention. Indeed, any configuration that forms a loop, and provides the benefits discussed herein, is within the contemplation of the present invention. For example, the loop does not necessarily have to have a second straight portion, as the beach can extend directly off of the first straight portion, and can extend in arc-shape all the way around a large first turn, eliminating the need of a second turn.

Figure 5B:
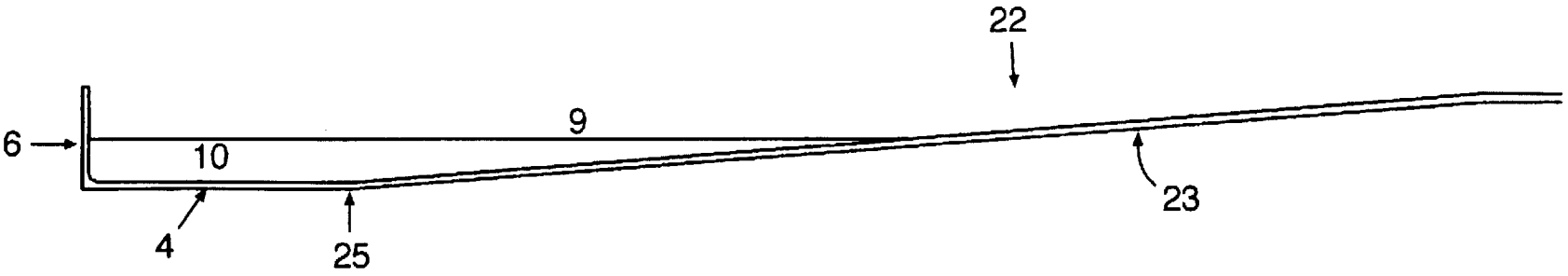
FIG. 5*b* is a section view of the beach area.

As shown in FIG. 1, in the preferred embodiment, at the junction of the second straight portion 20 and the beach area 22, the outside wall 8 curves radially outwardly 26 to create a relatively wide, radially outwardly extending beach area. The beach area 22 in general extends co-extensively from the perimeter 25 of the larger second turn 21 of the channel loop, and extends radially upward therefrom. The slope of the beach area is preferably about 12 to 1, as shown in FIG. 5*b*, extending generally radially outwardly from the channel floor from the outside perimeter 25 of the second turn, although a variety of slopes are within the scope of the present invention. While the floor 23 of the beach is formed in the same manner as the channel floor, except at a sloped angle, an artificial surface simulating the appearance of sand can be sprayed or otherwise placed on the beach floor to simulate more closely the beaches that occur in nature, without creating the problems associated with using loose sand, which can interfere with various aspects of the pump. The inside radius of this larger turn 21 is preferably about 75 to 85 feet, although the radius can vary substantially, as long as the benefits discussed herein are provided. In the preferred embodiment, the outside radius of the beach, which co-extends from the large turn, and forms the sloped surface of the beach, is between about 145 feet to 190 feet or more. The beach can, if desired, be made larger to accomodate other beach related activities.

The angle at which the channel 2 is interconnected to the beach area 22 is determined by the curvature of the larger turn, having an inside radius of about 75 to 85 feet. That is, because the second straight portion 20 of the channel ends where the second large turn 21 and beach begins, and the beach area extends radially outward from the large turn, the curvature of the large turn determines the angle at which the second straight portion is interconnected with the beach area. The angle at which water from the channel, including the swell moving through the channel, enters the beach area, therefore, is the angle of the tangent of the radius of the larger turn. In the preferred embodiment, the beach is formed along what would otherwise be the outside wall of the second turn extending radially outwardly in plan view as shown in FIG. 1.

Figure 7:
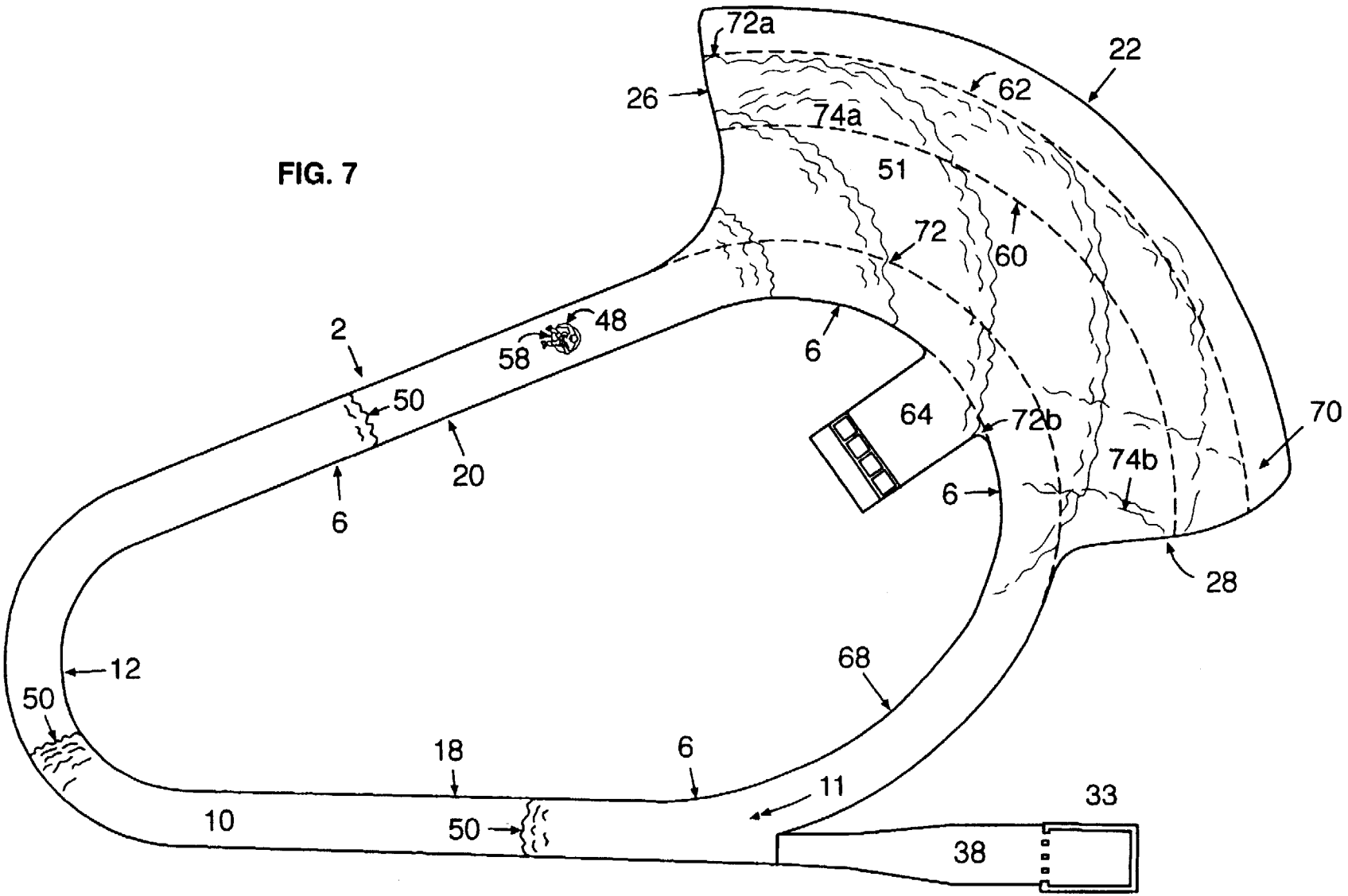
FIG. 7 is a plan view of the present invention showing the formation of the waves.

The channel along the inside of the larger turn is substantially the same depth and width as the rest of the channel. However, because the outside wall gives way to form the sloped beach area, this area of the channel is capable of storing a significantly larger volume of water. That is, when the water ride is not in operation, water extends up onto the beach in the shape of an arc up to the static water line 60, as shown in FIG. 7, seeking its own level. When the water ride is in operation, the momentum of the spilling wave that breaks onto the beach allows water to flow substantially beyond that point, up to the second water line 62, or higher, causing water to flow substantially up the sloped surface of the beach. Indeed, where the swells are large, the second water line 62 can extend radially outwardly, towards the outside perimeter of the beach area, or even beyond. Accordingly, the outside perimeter of the beach area is preferably extended far enough, such that the waves can fully spill over and break onto the beach, and still allow some room for other beach related activities to be performed thereon. An additional wall 29, as shown in FIG. 6, can also be placed along the outside perimeter of the beach to contain the water if desired.

The beach area 22 is preferably substantially symmetrical and extends about 120 to 150 degrees around the larger turn, although smaller and larger turns, shorter and longer beaches, as well as unsymmetrical ones, are also within the scope of the present invention. At the far end 70 of the beach area, the outside wall of the channel 8 extends radially outwardly to integrally form the outside wall 28. The outside wall 28 of the beach area extends substantially vertically upward from the beach such that the waves that travel across the beach eventually encounter the wall. In an alternate embodiment, as shown in FIG. 6, the far end 70 of the beach has an additional sloped surface 27, such that the waves that travel across the beach and extend to the far end will also flow up the beach, spill over and break, rather than encountering the far wall.

Figure 5C:
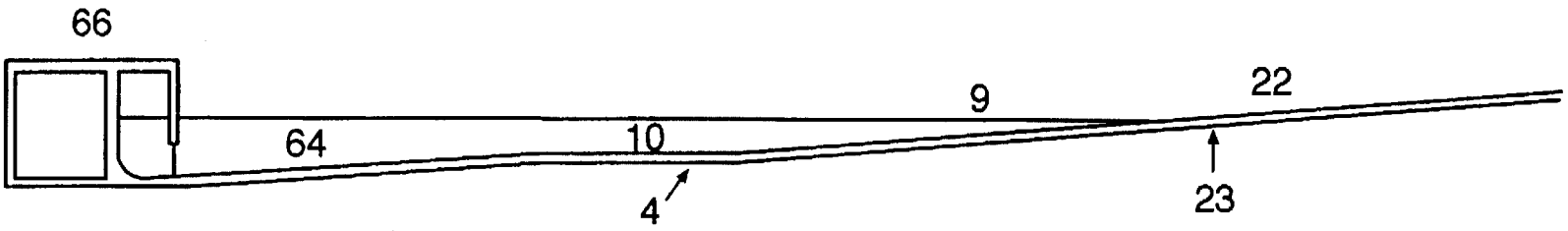
FIG. 5*c* is a section view of the beach area with the wave pool.

As shown in FIG. 1, an additional wave pool 64 with a conventional wave generator 66 can be located along the inside turn of the loop directly across from the beach. The pool serves to create additional periodic waves along the beach. The periodic waves can create additional water effects on the beach. It can also be used to control or diffuse the energy of the solitary waves travelling across the beach, if desired, to create waves that are less severe on one side of the beach than the other. The pool is preferably built into the channel, wherein the walls and floor are integrally formed with the channel, as shown in FIG. 5*c*, although the floor of the pool area can be slightly lower than the channel.

The channel 2 continues beyond the beach area, as shown in FIG. 1, extending around the second turn 21. This portion 68 of the channel is preferably the same size as the rest of the channel. Water is pumped from the channel and into the sump area from this portion of the channel. The curvature of the channel along this portion is generally an extension of the curvature of the larger second turn, although not necessarily so. As shown in FIG. 1, the curvature of this portion can be larger than the large turn 21, having a raduis of about 140 to 160 feet, if desired. To complete the loop, this portion of the channel continues around to the discharge area 40.

Operation of the Invention:

In use, the channel is preferably filled with water up to a depth of about 42 inches, such that water extends onto the beach 22 up to about the static water line 60. The water in the channel is preferably continuously treated with any known purification system to ensure that the water is clean and safe.

In general, a large quantity of water is pumped up to an elevation that is higher than the elevation of the water in the channel, and is suddenly released, so that the momentum of the water being released causes a solitary wave to form, and carries a rider in a large swell, pushing him/her downstream through the channel. The momentum of the water being released causes the rider to be quickly carried and accelerated through the channel. The rider can float, such as in a tube, swim, or otherwise manuever, if desired, in the swell as it moves forward through the channel. With enough experience, riders can perform surfing and/or skimming manuevers on the forward moving swell, which is comparable to riding swells in the ocean.

To begin the water ride, water is drawn from the channel through the sump area by the pump and into the tank. The release gate 44 preferably remains closed to seal the opening 47 while the tank is being filled. Some water, however, may be allowed to escape through the opening, by setting the gate, if desired, to allow water to begin flowing into the channel, to create the unidirectional flowing body of water, in advance of the first surge.

A predetermined amount of water is allowed to enter the tank, depending on the desired water effects. Tests have shown that the volume of water in the tank is the primary factor in determining the size and speed of the surge, and therefore, the swell, that forms and travels through the channel. The dynamic head in the tank, i.e., elevation of the water in the tank, will determine the amount of pressure that is exerted in the tank as the water is released, and therefore, have an effect on how quickly the water is released. So long as the opening 47 at the bottom of the tank is at an elevation that is lower than the elevation of the water in the tank at the time water is released, however, there should be enough pressure to cause all of the water in the tank to be released due to gravity alone.

The quality of the swells, and therefore, the waves can be controlled by the amount of water pumped into the tank, and how quickly water is released. The more water is pumped into the tank, the greater the overall momentum, energy and mass that is transferred to the body of water in the channel, and conversely, the less water is pumped into the tank, the less the overall momentum, energy and mass that is transferred. Given that the preferred level of water in the channel is about 42 inches, that the channel is about 20 feet wide, and that the preferred opening of the tank is about 65 square feet and about 4 feet high, the preferred amount of water in the tank, to create a viable surge, is about 40,000 to 50,000 gallons.

The rate at which the water is released through the opening will also determine how the swell will develop. If water is released at once, a relatively large swell will be formed, due to the impact of releasing substantially all of the total volume of water quickly. On the other hand, if the water is released relatively slowly, the impact will be diffused, and spread over time, such that one long swell, or several smaller swells, will be created. In such case, the swells will tend to travel slower through the channel, and be relatively smaller, and less powerful.

The release gate 44 can be released at intervals, or in a series periodically, to create additional water effects. The release gate has the capability of opening completely within less than 4 seconds, and preferably, about 2 seconds, and closing at the same rate. The release gate can be opened and closed in this fashion at intervals ranging from every 10 seconds or less, to every 2 minutes or more. For example, the release gate can be opened for a short period initially, and then closed, followed by opening the gate for a slightly longer period, and closed, and then again followed by opening the gate for an even longer period, until all of the water in the tank is released. In this manner, the first swell will be the smallest of the three swells to travel through the channel, and therefore, the slowest, and the second swell will be slightly larger and travel slightly faster, and the third swell will be the largest and travel the fastest. Accordingly, as the swells travel through the channel, the second swell will catch up to the first swell, and the third swell will catch up to the first two swells, and as the swells combine and enter the beach, one large swell will form, spill over and break onto the beach.

When the water is released, the water surges down the discharge channel, and converges somewhat at the point where the discharge channel narrows 39. The convergence actually helps to accelerate the surge through the discharge channel and into the channel, and also to isolate the turbulence caused by the surge entering the body of water. By isolating the turbulence, there is less likelihood that undesireable water effects will be created, which can impede the formation of the swell, such as excessive shear flows, eddies, whirlpools, aeration, bubbles, etc., across the width of the channel. Because the discharge channel is horizontal along the lower portion 38*a*, and about 6 inches below the surface level of the water in the channel, the surge, which can be about several inches to over 5 feet high, encounters the body of water at or near its surface. The momentum, energy and mass of the surge is transferred to the body of water, causing a swell to form within the channel downstream from the discharge area. Momentum and energy is transferred by the speed and power of the surge, and mass is transferred by the overall mass of water being released, which all contribute to creating the swell.

Water entering the channel also seeks its own level. Introducing additional water into the channel quickly creates a hydraulic pressure differential between the body of water in the channel and the oncoming surge, as water builds up around the discharge area 40. Accordingly, water from the surge will tend to seek areas of the body of water that are lower in surface elevation, which can be in the direction of flow, or against. Water is also withdrawn from the channel through the grate, at a location immediately upstream from the discharge area 40, creating an additional relatively low pressure area along the portion of the channel 68. Accordingly, there is some tendency for water in this area to flow, at least at surface level, upstream in a direction opposite the direction 11. Nevertheless, the momentum, energy and mass of the water entering the channel in the predetermined direction, which is downstream, causes most of the surface water to flow downstream, leaving only a slight surface flow of water travelling upstream in the opposite direction.

Figure 7A:
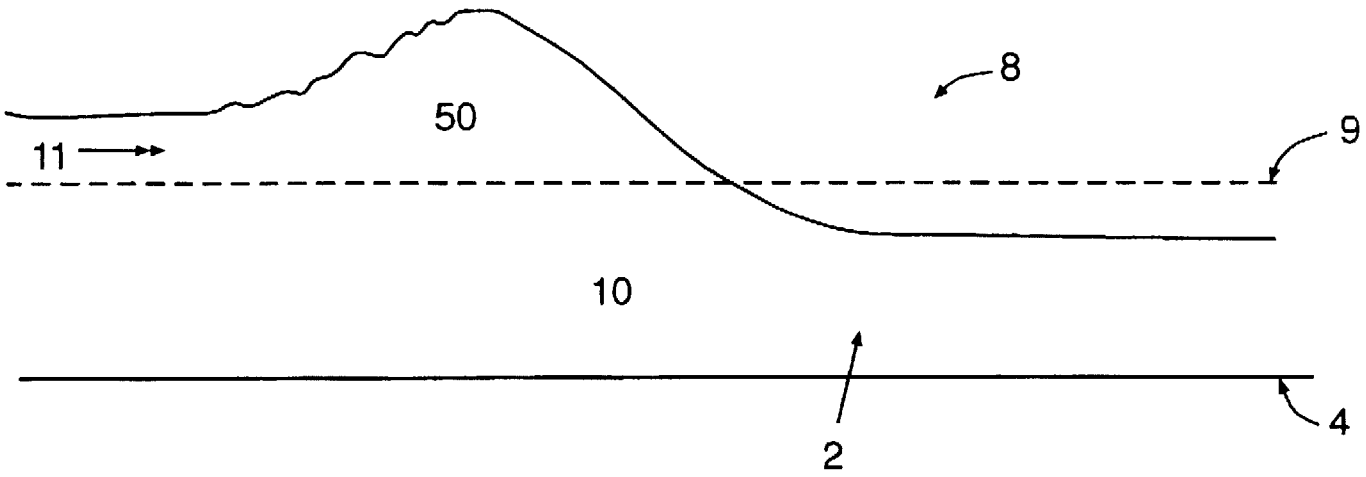
FIGS. 7*a*–7*d* are section views showing the wave and swell formations.

Repeated surges into the channel in the direction of flow eventually cause the entire body of water to form a current, through momentum and energy transfer, unidirectionally through the channel. This allows riders 48 floating in the channel on innertubes 58 to float downstream with the current, if desired. Nevertheless, the body of water flows at a speed that is substantially slower than the surge, due to the large volume of water in the channel. Once the swell 50 is created, as shown in FIG. 7*a*, the swell travels through the channel, generally moving through the body of water, rather than with it. The swell is primarily created by the transfer of energy, not fluid transfer, although not necessarily so. Accordingly, the swell travels much faster around the channel loop than the body of water in the channel. The quality of the swell varies, from one that is smooth, to one that spills over and bubbles, forming white water effects thereon. The size of the swell depends on various factors already discussed, but is preferably between 1 to 4 feet high. With the proper combination of volume, speed, depth, etc., the swell can form without spilling over, such that the swell travels all the way around to the beach area before it actually spills over and breaks. On the other hand, the swell can travel through the channel, spilling over from the beginning, all around the channel loop, due to certain residual turbulence caused by the surge, and/or effects created by the channel and the flowing body of water therein. In addition, along the first turn 18, even if the swell is smooth up to that point, the swell will tend to tilt up onto the outside wall 14 of the channel, and as the swell comes off of the turn, the tilted body of water will cross over within channel, creating turbulence, shear flows, and aerations, etc., along the way. Other water effects, including the flowing body of water, and reverse swells, which will be discussed, also affect how the swell develops and travels through the channel. Riders 48, with enough skill, can ride the swell all the way around the channel, and perform surfing and/or skimming manuevers thereon.

Figure 7B:
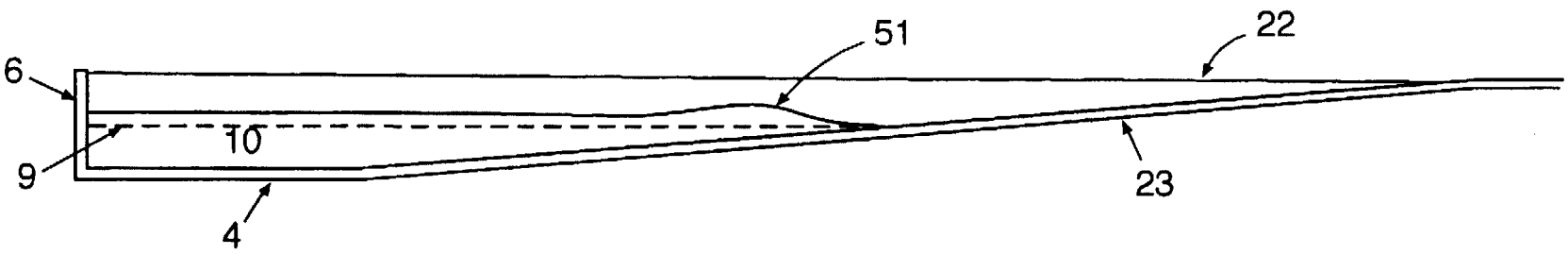
Figure 7C:
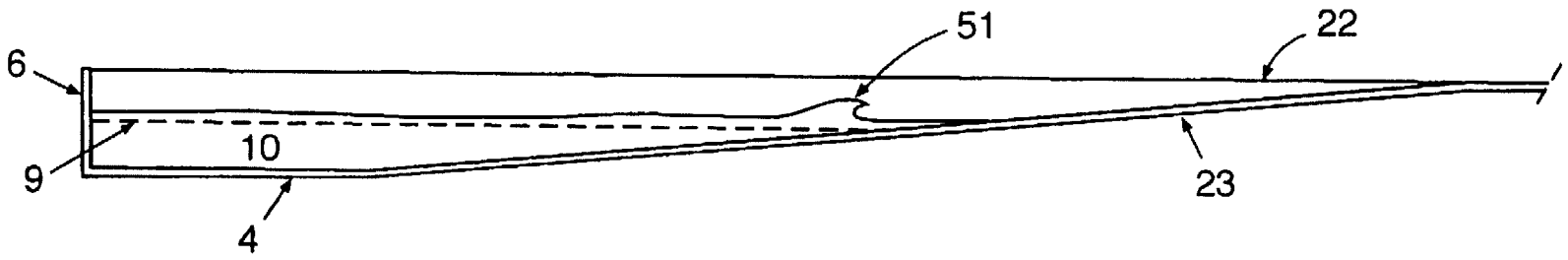

As the swell enters the beach area, the swell forms into a wave 51, as shown in FIG. 7*b*, as it approaches the sloped surface of the beach. The upward slope causes additional friction along the bottom of the swell, such that as the swell travels towards the slope, the top portion of the swell spills over onto the lower portion of the swell, as shown in FIG. 7*c*, which has been slowed down by the sloped beach, and continues to flow up the beach.

Because the channel is relatively narrow, compared to the beach, each wave 51 that enters the beach 22 extends radially outwardly in the shape of an arc equidistant from the point where the beach begins, as shown in FIG. 7, just as a ripple extends outward from the center. Of course, the example of FIG. 7 shows periodic waves, rather than a single solitary wave, for illustration purposes. One end of the arc 72*a*, along the beach side, hugs the outside wall 26 as it extends radially outward, and the other end 72*b*, along the channel side, hugs the inside channel wall 6. The waves travel radially outwardly, in this manner, such that, along the beach side of the arc, the waves travel directly up the slope of the beach, until they spill over and break onto the beach. The waves continue to spill over and break onto the beach in this manner all the way around the perimeter of the turn. As shown in FIG. 7, the waves, along the beach end of the arc, travel up the slope of the beach, causing the water level to rise from the static water line 60 to about the second water line 62. Friction from the upwardly sloped surface of the beach acts upon the waves, along that end of the arc, causing the waves to spill over and curl onto the beach in a large sweeping arc.

Figure 7D:
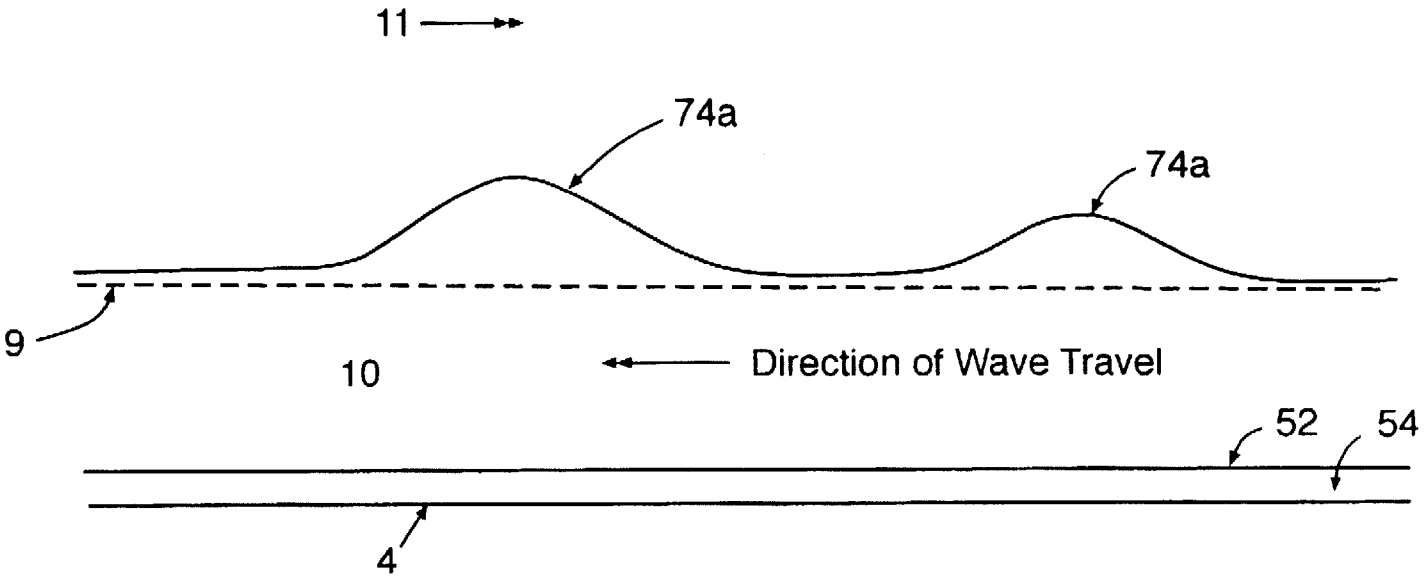

The wave that spills over and breaks onto the beach, particularly near the wall 26, also creates a back flow that causes water to flow down the slope of the beach. The wave also raises the water level of the beach area, relative to the water level in the channel, after the swell has passed through, creating a hydraulic pressure differential between the body of water in the channel, and along the beach area. The back flow from the beach, in combination with the hydraulic pressure differential created between the beach and channel area, creates a reverse wave, which becomes a reverse swell 74*a*, as shown in FIG. 7*d*, that travels through the channel in the opposite direction upstream. Riders riding the original swell, and unable to catch the wave onto the beach, can actually ride the reverse swell through the channel, if desired. In the channel, the reverse swell can encounter the next oncoming swell in the direction of flow to create spectacular water effects, although the energy of the respective swells are sufficient to cause them to cross through each other and to continue to travel in the opposite direction.

As the original wave 51 travels across the beach, residual effects from the periodic wave generator 66 can cause the original wave 51 to dissipate, as the periodic waves, and back flows resulting therefrom, cross into the path of the original wave. This is useful where it is desirable to lessen the energy of the wave on the far end 70 of the beach. The waves eventually hit the far wall 28 at the far end 70 of the beach, or in the alternative embodiment, flow up the slope 27 of the beach, as shown in FIG. 6. In either case, the waves rebound from the far end, causing additional reverse waves 74*b* to form, as shown in FIG. 7, which travel in the opposite direction across the beach. In the preferred embodiment, the waves bounce off of the wall 28, swelling up against the wall, and rebounding in the opposite direction. In the alternative embodiment, the waves spill over and break onto the far beach area 70, and a back flow is created by the sloped surface of the beach 27, which causes reverse waves to form and to travel in the opposite direction. When the next wave 51 enters the beach, therefore, and encounters the reverse waves, additional wave collisions can take place, creating unique water effects along the beach. The waves rebounding from the far wall and within the channel near the far end of the beach are also residually created and continue to bounce back and forth within the channel and beach area, creating additional water effects.

Water from the beach area eventually flows into the channel portion 68 due to the current of the body of water, which travels unidirectionally around the channel loop. As discussed, the current is created by the repeated surges from the tidal wave generator, and is also affected by the withdrawal of water by the pump from the portion 68 of the channel. Because the body of water in the channel continues to flow unidirectionally, each swell 50 and reverse swell 74*a*, travels through the channel, relative to the motion of the body of water. Therefore, the speed at which the swells travel, relative to the channel, can actually be increased by the flowing body of water in the channel, or in the case of the reverse swells, decreased.

Other unique water effects are created along the beach area due to the angle and orientation of the channel with respect to the adjacent beach. Unique aspects of this combination include the slope and orientation of the beach relative to the channel, the horizontal angle at which the swell enters the beach, and the degree of tightness of the curvature of the beach, etc. Indeed, many different water movements are created by this combination, which help to form unique water effects. The following factors contribute to these water movements: the speed and depth of the body of water flowing through the channel, the size and speed of the swell moving through the water, the size and speed of the solitary wave that spills and breaks onto the adjacent beach area, the extent of the continuation of the spilling wave that peels radially around the turn, the extent of the back flow of water moving in a reverse direction radially inward towards the channel from the beach area caused by the upwardly sloped surface of the beach, the rebounding effect of water caused by the relative narrowing of the channel as the beach area comes to an end, and the natural amplification of motion caused by the combination of all of these movements together. Other water effects not discussed herein can also be created by making certain adjustments, including but not limited to, adjustments to the channel, the beach, the relationship and orientation between the channel and beach, the flow speed, direction, and volume of water in the channel, and of water released into the channel by the solitary wave generator, the type of solitary wave generator used, the angle at which the water enters the channel, the angle of the turns in the channel, the topography of the channel walls and floor, etc., which are all within the contemplation of the present invention.

What is claimed is:

1. A water ride attraction for use in amusement parks, water theme parks, and the like, comprising:

a channel of water in the form of a loop, wherein the loop has at least one turn thereon;

a wave generator for creating a surge of water;

a discharge channel connecting said wave generator and said channel, through which said surge of water can travel and enter into said channel; and a sloped area connected to said channel extending substantially along at least a portion of said one turn, wherein the sloped area has an inclined sloped surface thereon, and wherein the surge of water in said channel has sufficient energy to cause a swell to form in said channel, and at least a portion of the water to flow up the sloped surface in a first direction, wherein said sloped surface causes at least a portion of said flow of water to reduce in speed and flow back down into said channel in a second direction.

2. The water ride of claim 1, wherein the water in the channel is substantially uniform in elevation, but for water effects created by the surge of water.

3. The water ride of claim 1, wherein the surge of water can be released by said wave generator, and introduced into said channel, creating a large swell that travels through said channel and around said loop, creating a wave that travels across the sloped area, and spills over and breaks thereon.

4. The water ride of claim 1, wherein the wave generator comprises at least one pump, a sump area, and a tank, wherein water from said channel can be pumped into the tank, and wherein the tank has at least one opening, and at least one release gate, such that water can be stored in said tank, and released through said opening.

5. The water ride of claim 4, wherein the release gate can control the rate, and the amount, at which water is released from said tank into said channel, to control the surge, and can be timed to release said surge at preselected intervals.

6. The water ride of claim 1, wherein the discharge channel is sloped downward from the wave generator to cause said surge of water to flow into said channel, wherein the discharge channel has a substantially horizontal portion adjacent said channel, and narrows to cause said surge to converge before entering said channel.

7. The water ride of claim 1, wherein the discharge channel is connected to said channel substantially tangentially, such that the surge flowing from said wave generator enters into said channel to create, through momentum transfer, a unidirectional flowing body of water in said channel.

8. The water ride of claim 1, wherein the sloped area comprises a beach area that is oriented with respect to the channel such that, when the surge from the wave generator enters the channel, and travels around the loop, forming a swell therein, the swell enters the beach area and forms one or more radially outwardly traveling waves thereon, wherein the sloped surface of the beach area causes one end of the wave to spill over and break, prior to the other end, as the wave travels around the turn.

9. The water ride of claim 8, wherein the curvature and slope of the beach area causes, in combination with the water effects created by the spilling/breaking wave, reverse waves and swells to form which travel against the direction of the original wave, and through the channel in a reverse direction.

10. The water ride of claim 8, wherein walls are provided along the beach area which cause the waves in the beach area to bound and rebound, creating residual waves and flows, and other water effects in the channel and beach area.

11. The water ride of claim 1, wherein a wave pool is positioned substantially on the inside of said turn, facing said sloped area, wherein another wave generator is provided which creates periodic wave formations that flow onto the sloped area.

12. The water ride of claim 1, wherein at least a part of the discharge channel has a turn, such that, as the surge of water flows onto said discharge channel, the water converges against the outside of the turn.

13. The water ride attraction of claim 12, wherein said discharge channel has a dividing wall therein extending substantially in the direction of said surge of water which helps to reduce turbulence in the water before entering said channel.

14. The water ride of claim 1, wherein there is at least one additional turn along the channel loop, wherein the outside wall along the additional turn is substantially high enough to contain the water, which tends to tilt upward against the outside wall.

15. The water ride attraction of claim 1, wherein the channel has a floor and the sloped area extends relatively upward from said channel floor substantially radially outward in relation to said channel substantially along the curvature of said one turn.

16. A water ride attraction for use in amusement parks, water theme parks, and the like, comprising:

a channel loop containing a body of water flowing in a predetermined direction;

a wave generator for creating motions in said body of water and which can drive said flowing body of water in said predetermined direction; and a beach area connected to said channel, wherein the beach area is oriented substantially outward in relation to said channel, and has an inclined sloped surface thereon extending substantially upward in relation to said body of water, and wherein the motions create at least one swell that travels through the channel, and enters the beach area, such that at least a portion of the swell travels up the sloped surface in a radially outward direction, and wherein the sloped surface of the beach area causes at least a portion of the swell to spill over and break and form at least one wave that spills over and breaks along the sloped surface of said beach area.

17. The water ride of claim 16, wherein repeated surges are created by said wave generator to create repeated motions and waves that flow onto said beach area.

18. The water ride of claim 16, wherein at the far downstream end of the beach area, there is provided an additional sloped surface, wherein the wave travels across the beach area and eventually flows onto said additional sloped surface, wherein the additional sloped surface causes at least a portion of the water from said wave to reduce in speed, spill over and break, and to flow back against the direction of the original wave, creating a reverse wave.

19. A water ride attraction for use in amusement parks, water theme parks, and the like, comprising:

a channel of water in the form of a loop, wherein the loop has at least one turn thereon;

a wave generator associated with said channel adapted to create a surge of water that enters into said channel to form a swell therein; and a beach area connected to said channel, wherein the beach area has an inclined sloped surface thereon, wherein at least a portion of the sloped surface substantially follows the curvature of said one turn, and wherein the beach area is oriented with respect to the channel such that, when the surge from the wave generator enters the channel, and travels around the loop, forming a swell therein, the swell enters the beach area and forms a radially outwardly traveling wave thereon, wherein the sloped surface causes one end of the wave to spill over and break, as the wave travels around the turn, and wherein one or more walls are provided along the beach area which causes waves in the beach area to bound and/or rebound, creating residual waves and flows, and/or other water effects in the channel and beach area.

20. The water ride of claim 19, wherein the channel has a floor, an inside wall and an outside wall, wherein the outside wall is interrupted and extends radially outward in relation to the inside wall along said one turn at opposite ends of the beach area.

21. The water ride attraction of claim 19, wherein the wave generator is located adjacent said channel.

22. A method of creating waves, comprising:

providing a channel having a body of water therein and at least one turn thereon;

providing a sloped area having an inclined sloped surface extending substantially outward in relation to said channel, along at least a portion of said turn, and upward in relation to said body of water in said channel;

releasing a substantial amount of water into said channel to create a large forward moving swell through said channel; and causing said swell to travel through said channel and at least a portion of the water to flow upward in relation to said body of water onto said sloped surface, said sloped surface causing said swell to spill over and break to form at least one wave on said sloped area.

23. The method of claim 22, comprising releasing said substantial amount of water into said channel at intervals to cause a series of forward moving swells to form in said channel.

24. The method of claim 22, comprising repeatedly releasing said substantial amount of water to cause said body of water in said channel to flow in a predetermined direction, wherein each time said water is released, momentum and energy from said water being released is transferred to said body of water.

* * * * *